United States Patent [19]

Watanabe et al.

[11] 4,228,644

[45] Oct. 21, 1980

[54] DISPLAY DEVICE FOR CALENDAR TIMEPIECES

[75] Inventors: Minoru Watanabe, Tokorozawa; Munetaka Tamaru, Tokyo, both of Japan

[73] Assignee: Citizen Watch Co., Ltd., Tokyo, Japan

[21] Appl. No.: 958,668

[22] Filed: Nov. 8, 1978

[30] Foreign Application Priority Data

Nov. 16, 1977 [JP] Japan ..... 52/136732
Nov. 24, 1977 [JP] Japan ..... 52-141034

[51] Int. Cl.[3] ..... G04B 19/24

[52] U.S. Cl. ..... 368/28; 368/37; 368/77

[58] Field of Search ..... 58/4 R, 4 A, 5, 58, 58/85.5, 127 R; 40/107, 111, 113

[56] References Cited

U.S. PATENT DOCUMENTS

| | | | |
|---|---|---|---|
| 2,764,828 | 10/1956 | Wolauer | 58/4 R |
| 3,452,535 | 7/1969 | Cabantous et al. | 58/58 |
| 3,673,789 | 7/1972 | Tsuzuki et al. | 58/58 |
| 3,729,922 | 5/1973 | Wein | 58/5 |
| 3,842,590 | 10/1974 | Kato | 58/58 |

FOREIGN PATENT DOCUMENTS

| | | | |
|---|---|---|---|
| 2264270 | 7/1974 | Fed. Rep. of Germany | 58/58 |

*Primary Examiner*—Vit W. Miska
*Attorney, Agent, or Firm*—Birch, Stewart, Kolasch & Birch

[57] ABSTRACT

A display device for calendar timepieces having a month display for the purpose of displaying the date indication in large size. To this end the device comprises a date dial and month dial, in which the month indication is displayed only at beginning of the month for informing the change of month. The month display may be performed by disclosing the month indication through an opening provided in the date dial through which the month indication is revealed or by utilizing a month indicating projection radially projected over the date dial.

16 Claims, 15 Drawing Figures

DISPLAY DEVICE FOR CALENDAR TIMEPIECES

BACKGROUND OF THE INVENTION

The present invention relates to a display device for calendar timepieces and more particularly to a month displaying device.

There has been provided a calendar watch having an automatic correcting device for the varying the lengths of a month. In the calendar watch, the date dial is driven two steps on the night of the 30th day of an even month to bring the date indication "1" into the date window at the beginning of the next month. Accordingly, date display is automatically corrected according to the length of month.

In such a calendar watch, it is preferable to provide a month display to display the month which has been set in the watch to the user, and which is useful to correct the date. However, since the space for the calendar display window is limited, it is too small to indicate visibly the month together with the date and day in one window. In order to correct the date, it is necessary to know the change of the month during the correcting operation.

SUMMARY OF THE INVENTION

It is an object of the present invention to provide a calendar display device which indicates the month together with the date indication "1" to indicate the change of month.

In accordance with the present invention, the calendar display device comprises calendar indicating dials including a date dial adapted to be rotated one step every 24 hours and a month dial adapted to be rotated one step during the rotation of said date dial between the date indications "31" and "1", a window for displaying indications on said date dial and month dial, and means for disclosing the month indication in said window at a predetermined time.

These and other objects and features of the present invention will become fully apparent from the following detailed description in conjunction with the accompanying drawings.

Figure 1:
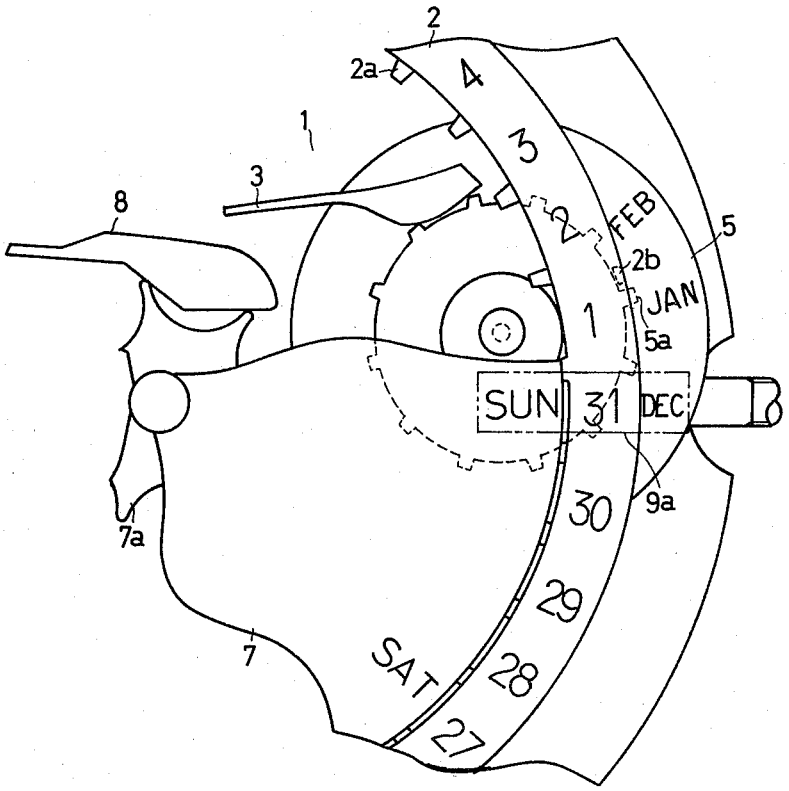
FIG. 1 is a plan view of a calendar display device of the prior art.
Figure 2:
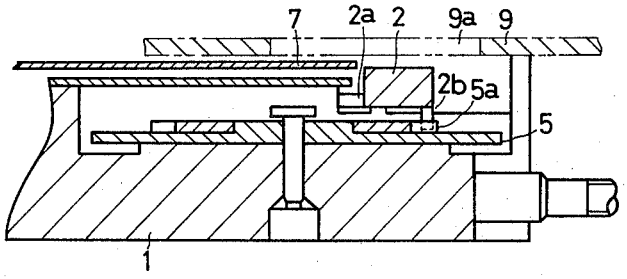
FIG. 2 is a sectional view of the device of FIG. 1.

Referring to the drawings and more particularly to FIGS. 1 and 2 showing the prior art, an annular date dial 2 having a toothing 2*a* is rotatably supported on a base plate 1 and driven one step every 24 hours by a finger (not shown) engaged with the toothing 2*a*. A month dial 5 is rotatably mounted on the base plate 1 and positioned by a jumper spring 3. The month dial 5 is driven one step by engagement of a pin 2*b* of the date dial 2 with a toothing 5*a* during the rotation of the date dial between the indications "31" and "1". A week day dial 7 is secured to a star wheel 7*a* positioned by a jumper spring 8 and is driven by a not shown finger. Indications of day, date and month are displayed through a window 9*a* of a watch dial 9. Since the window is limited in size and divided into three displaying sections, each section must be reduced to small size. Therefore, it is difficult to see the indication on each dial. The present invention is to remove such a drawback.

Figure 3:
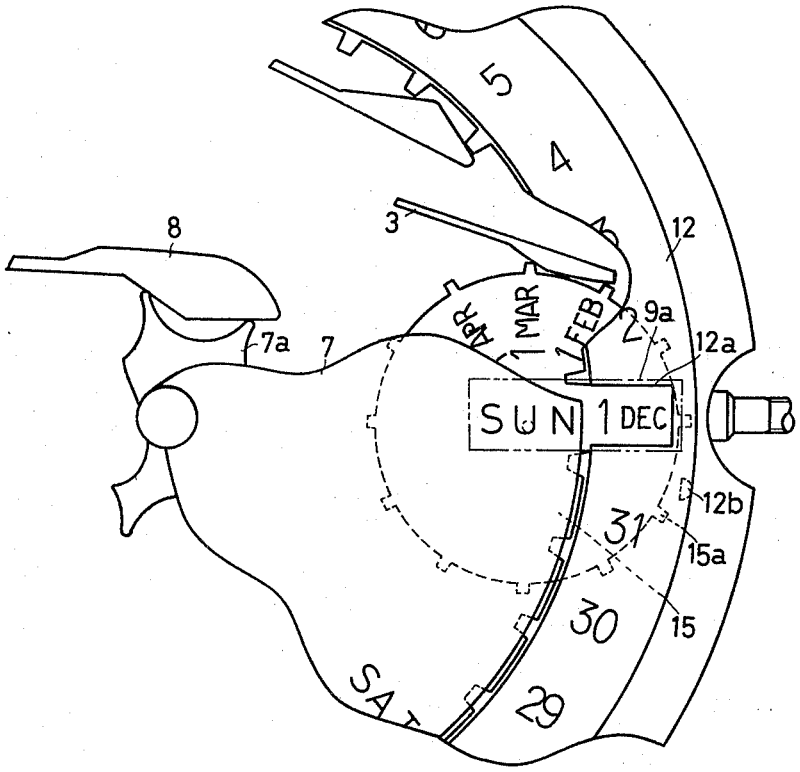
FIG. 3 is a plan view of an embodiment of the present invention.
Figure 4:
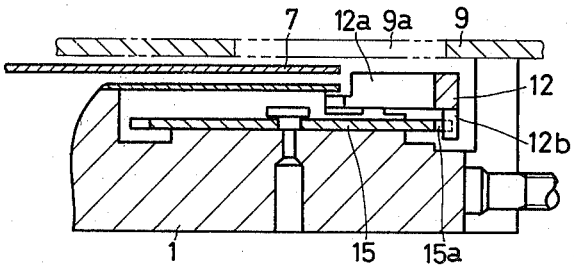
FIG. 4 is a sectional view of the device of FIG. 3.

Referring to FIGS. 3 and 4, an annular date dial 12 has an opening 12*a* as a window which is positioned at the date indication "1". Each of date indications other than "1" are printed within the space of about half of the window 9*a*. A month dial 15 is positioned under the date dial 12 and rotatably mounted on the base plate 1. The month dial 15 has a toothing 15*a* which is engaged with a pin 12*b* provided on the underside of the date dial 12. As mentioned above, the month dial 15 is driven one step by the pin 12*b* during the rotation of the date dial between the indications "31" and "1". In the window 9*a* of the watch dial 9, indications of the date dial 12 and the week day dial 7 are displayed. In this embodiment, date indication "1" is printed on the month dial 15 together with the month indication.

In operation, at the beginning of the month, the opening 12*a* of the date dial 12 is positioned in the window 9*a*, so that the month indication and date indication "1" may be observed. At midnight of the 1st day, the date dial is driven one step so that date indication "2" is brought in the window. The month dial 15 is covered by the date dial. Until indication "31", only the date indication is displayed in the window. However, it is also possible to indicate the change of the month during the date correcting operation at the beginning of month.

Figure 5:
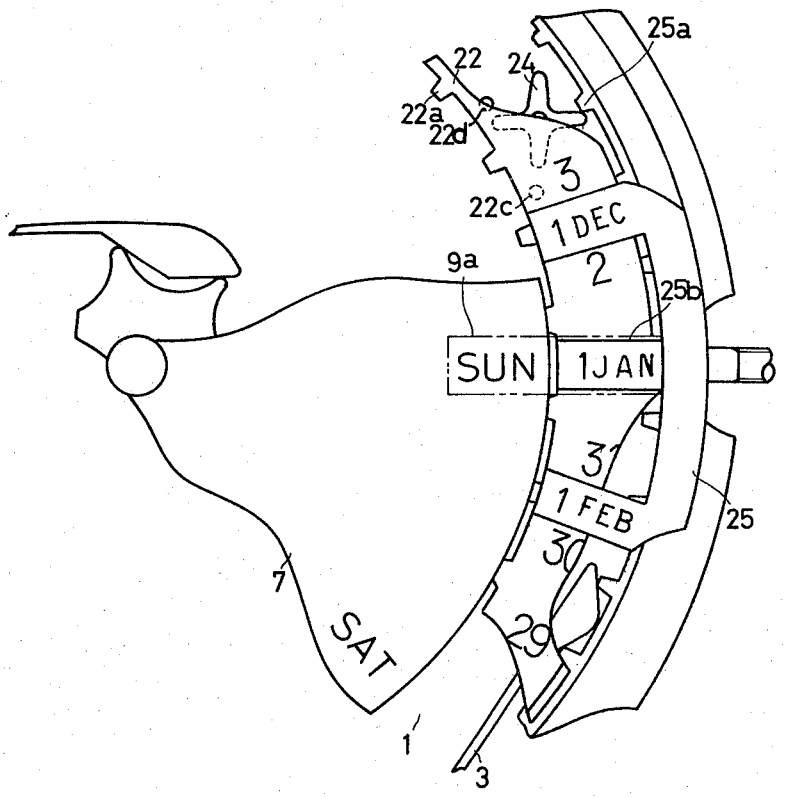
FIG. 5 is a plan view of another embodiment.
Figure 6:
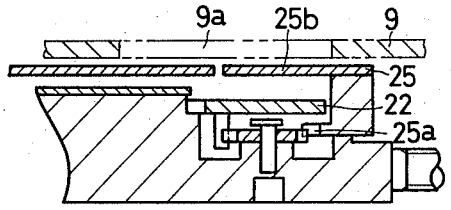
FIG. 6 is a sectional view of the device of FIG. 5.
Figure 7:
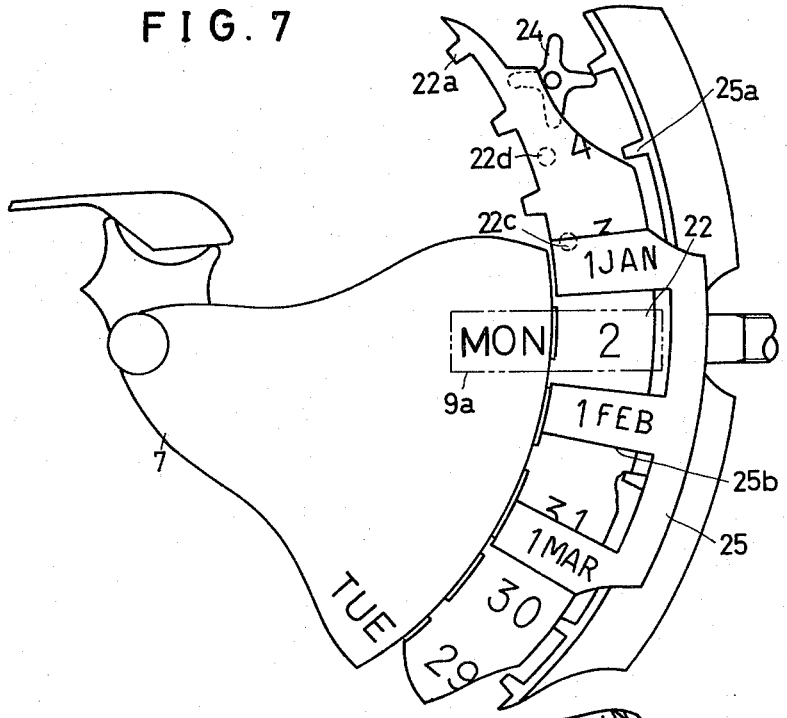
FIG. 7 is a plan view showing a further embodiment.

Referring to FIGS. 5 to 7, a month dial 25 has a toothing 25*a* and a series of month indicating projections 25*b*, each of which is inwardly projected over the date dial 22. The projections are arranged at a pitch of double the toothing 25*a*. On each projection, month indication and date indication "1" are printed. The toothing 25*a* is engaged with a month dial driving wheel 24 rotatably supported on the base plate 1. On the underside of the date dial 22, two pins 22*c* and 22*d* are provided, of which pin 22*c* is so disposed as to engage with the month dial driving wheel 24 during the rotation between the date indications "31" and "1" and the pin 22*d* is so arranged as to engage with the wheel between the date indications "1" and "2".

In operation, at midnight of 31st day of the month, dial 25 is driven one step by rotation of the wheel 24 caused by the engagement of the pin 22*c*, so that the month indication is displayed in the window 9*a* together with the date indication "1" as shown in FIG. 5. During the rotation between the indications "1" and "2", the month dial is driven once more by engagement of the pin 22*d*, whereby the projection 25*b* is removed to the underside of the watch dial 9 and the date indication "2" is displayed in the window 9*a* as shown in FIG. 7. During the operation between the date indications "2" and "31", the month dial remains in position behind the watch dial.

Figure 8:
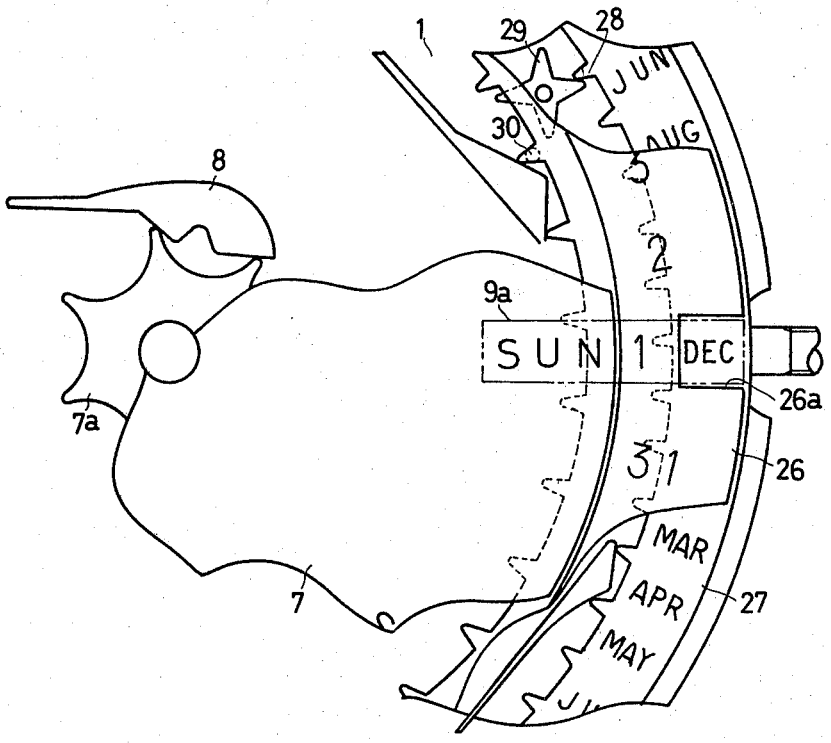
FIG. 8 is a plan view of still another embodiment.
Figure 9:
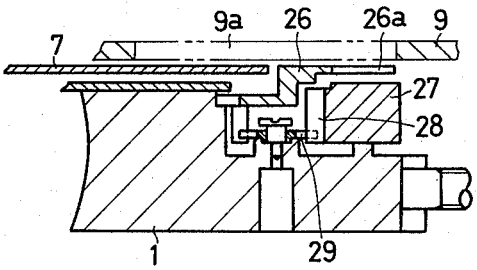
FIG. 9 is a sectional view of the device of FIG. 8.

Referring to FIGS. 8 and 9, a date dial 26 has an opening 26*a* at the outside of the indication "1". A month dial 27 is positioned under the date dial and each of the month indications is positioned to appear in the opening 26*a*. The month dial has a toothing 28 which is engaged with a driving wheel 29. The driving wheel is driven one step by a pin 30 provided on the date dial between the date indications "31" and "1" thereby rotating the month dial. Thus, the next month indication and the date indication "1" are brought in the window 9*a* as shown in FIG. 8, whereby the month indication may be observed through the window and opening. In the day other than 1st day, only date indication is displayed in the window. Since the letter "1" is simple and has a narrower width, the letter of each month indication may be printed in large size. Thus, the indications of the date and month may be easily observed.

Figure 10:
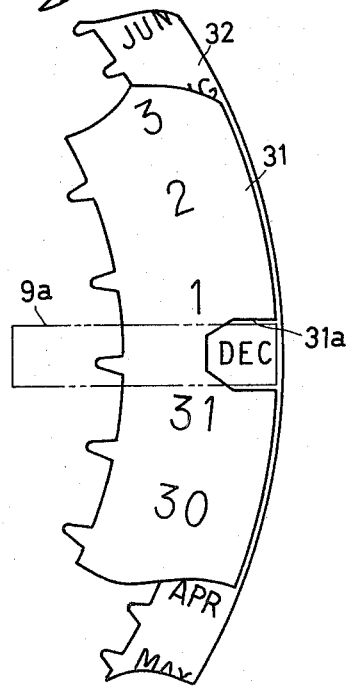
FIG. 10 is a plan view showing an another embodiment.

FIG. 10 shows another embodiment, there is illustrated a date dial 31 and a month dial 32, other parts are the same as the device of FIGS. 8 and 9. An opening 31*a* is positioned between the indications "31" and "1". Therefore, the month indication is displayed in the period in which the date indication changes from "31" to "1". In accordance with this embodiment, although the month displaying period is short, it is possible to indicate a charge in the month during the date correcting operation.

Figure 11:
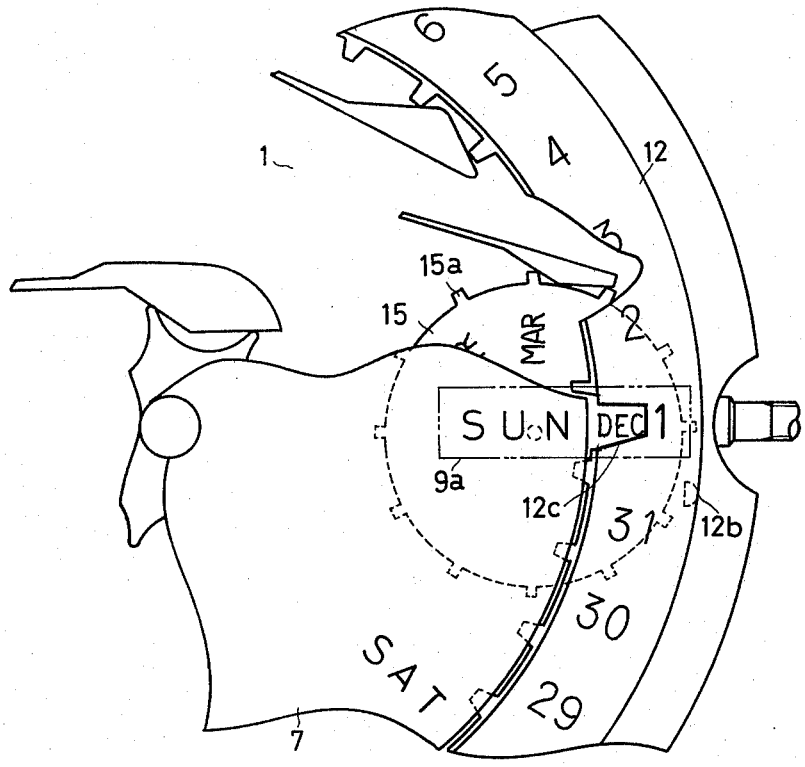
FIGS. 11 to 14 are plan views and sectional views showing other embodiments.
Figure 12:
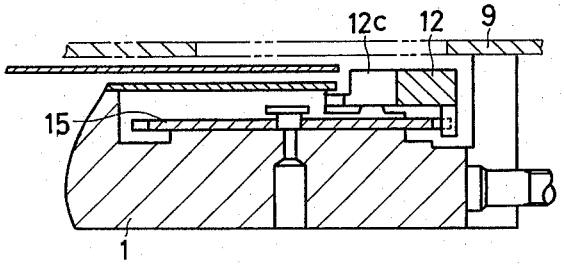

Referring to FIGS. 11 and 12, construction of this embodiment is similar to the first embodiment of FIGS. 3 and 4. Therefore, the same parts are identified with the same numbers as those of the previous embodiment of FIGS. 3 and 4. The date dial 12 has an opening 12*c* at the inside of the date indication "1" and the month indication on the month dial 15 is positioned to correspond to the opening 12*c*. Thus, the month indication is displayed in the window 9*a* together with the date indication "1".

Figure 13:
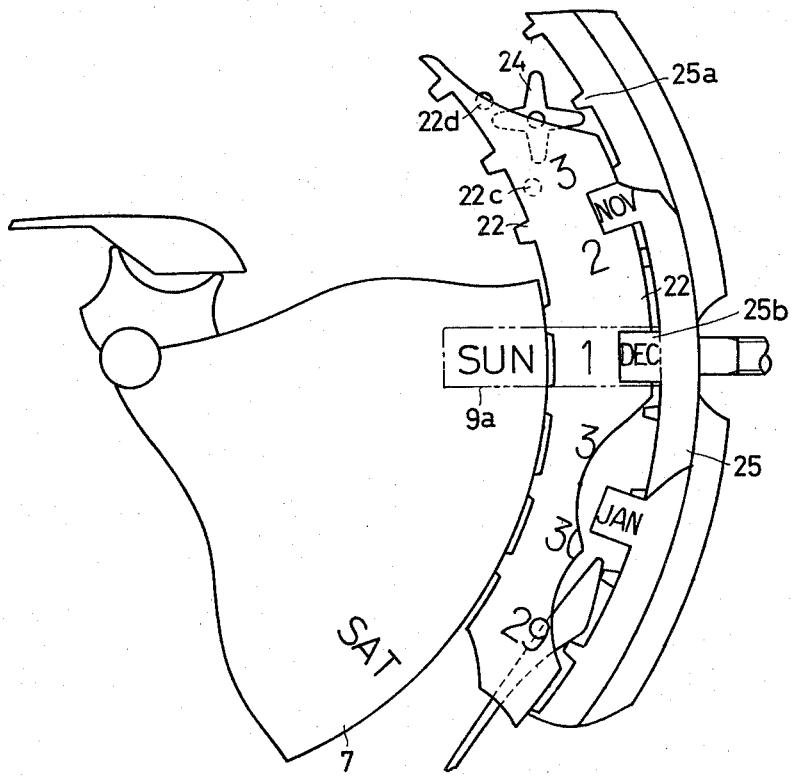
Figure 14:
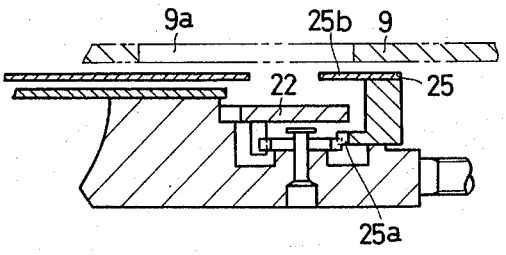

The device of FIGS. 13 and 14 is similar to that of FIGS. 5 to 7 and same numerals are used for identifying the same parts. On each projection 25*b*, the month indication is printed, so that it may be brought in the window only at the beginning of the month.

Figure 15:
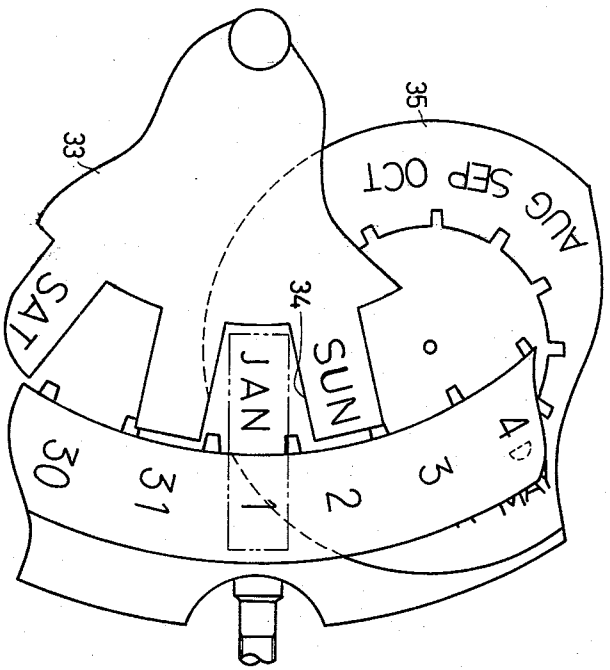
FIG. 15 is a plan view of a still another embodiment.

Referring to FIG. 15, the week day dial 33 has openings 34 at every space between the day indications, the month dial 35 is positioned under the week day dial to correspond to the opening. Therefore, the month indication is displayed in the window at the time when the day indication is changed.

It will be understood that month indication may be displayed at a time other than the 1st day, for example at the time of a single date indication such as 2nd to 9th day.

What is claimed is:

1. A display device for calendar timepieces capable of displaying a date and a month, comprising:

calendar indicating dials including, a date dial having date indications thereon, said date dial rotating one step every 24 hours, and a month dial having month indications thereon, said month dial rotating one step when said date dial rotates between said date indication "31" and said date indication "1";

window means disposed through said display device for displaying said date indications on said date dial and said month indications on said month dial; and means for exposing one of said month indications on said month dial through said window means for a short period of time during said month, said one of said month indications being hidden from view through said window means for the remaining period of time of said month.

2. A display device for calendar timepieces according to claim 1 in which said indicating dials further including a week day dial, and said means for disclosing the month indication comprises an opening provided in said week day dial.

3. A display device for calendar timepieces according to claim 1 in which said month dial comprises a series of month indicating projections over the date dial; and said means for exposing one of said month indications including means for rotating the month indicating projection into said window means for only said short period of time during said month.

4. A display device for calendar timepieces according to claim 3 in which the date indication "1" is printed on said month indicating projection adjacent the month indication.

5. A display device for calendar timepieces according to claim 3 wherein said short period of time commences at the beginning of the 1st day of each said month.

6. A display device for calendar timepieces comprising:

calendar indicating dials including a date dial having date indications and adapted to be rotated one step every 24 hours and a month dial having month indications and adapted to be rotated one step during the rotation of said date dial between the dial indications "31" and "1";

window means for displaying indications on said date dial and said month dial;

means for disclosing the month indication through said window means at a predetermined time, said date dial being positioned above the month dial, said means for disclosing the month indication including an opening provided in said date dial for revealing the month indication at a predetermined time.

7. A display device for calendar timepieces according to claim 6 wherein said short period of time commences at the beginning of the 1st day of each said month.

8. A display device for calendar timepieces according to claim 6 wherein said short period of time commences at the beginning of the 1st day and at the beginning of the 9th day of each said month.

9. A display device for calendar timepieces according to claim 2 in which said short period of time commences at the beginning of the 31st day of a preceding month and terminates at the end of the 1st day of a successively following month.

10. A display device for calender timepieces according to claim 2 in which the date indication "1" is printed on said month dial adjacent the month indication.

11. A display means for a calendar timepiece, capable of displaying dates and months, comprising:

day dial means having day indications thereon for displaying day information;

month dial means having month indications thereon for displaying month information;

means for rotating said day dial means and said month dial means; and window means disposed through an outer surface of said timepiece for permitting said day information and said month information to be displayed, said day dial means acting in synchronism with said month dial means such that said month information for one of said months is exposed through said window means for a period of time less than the duration of time of said one of said months, and said month information for said one of said months being hidden from view through said window means for the remaining duration of time of said one of said months.

12. A display means in accordance with claim 11 wherein said day dial means includes a plurality of openings equally spaced around the circumference of said day dial means, said month dial means having said month indications thereon being positioned below said day dial means in said time-piece relative to said window means, and one of said month indications on said month dial means being exposed through one of said openings in said day dial means and through said window means during said period of time less than the duration of time of said one of said months.

13. A display means in accordance with claim 11 wherein said month dial means includes a plurality of projections equally spaced around the circumference of said month dial means and having said month indications thereon, said day dial means being positioned below said month dial means in said timepiece relative to said window means, one of said projections on said month dial means covering one of said indications on said day dial means and being exposed through said window means during said period of time less than the duration of time of said one of said months.

14. A display means in accordance with claim 12 or 13 wherein said period of time less than the duration of time of said one of said months is a short period of time commencing at the beginning of the 1st day of each of said months.

15. A display means in accordance with claim 14 wherein said short period of time ends at the beginning of the second day of each of said months.

16. A display means in accordance with claim 12 or 13 wherein said period of time less than the duration of time of said one of said months comprises a plurality of individual time periods, said month indications being exposed through said window means during each of said individual time periods.

* * * * *